US005265771A

United States Patent [19]

Meshberg

[11] Patent Number: 5,265,771

[45] Date of Patent: * Nov. 30, 1993

[54] SELF-PURGING ACTUATOR

[76] Inventor: Philip Meshberg, 2500 S. Ocean Blvd., Bldg. 3, Apartment 1-A, Palm Beach, Fla. 33480

[ * ] Notice: The portion of the term of this patent subsequent to Mar. 31, 2009 has been disclaimed.

[21] Appl. No.: 821,375

[22] Filed: Jan. 16, 1992

Related U.S. Application Data

[63] Continuation-in-part of Ser. No. 526,594, May 22, 1990, Pat. No. 5,100,029.

[51] Int. Cl.[5] ..... B67D 5/00

[52] U.S. Cl. ..... 222/207; 222/190; 222/321; 239/333

[58] Field of Search ..... 222/148, 207, 209, 321, 222/341, 385, 406, 407, 190; 239/112, 113, 333, 428.5

[56] References Cited

U.S. PATENT DOCUMENTS

| | | | |
|---|---|---|---|
| 3,226,035 | 12/1965 | Boris | 239/355 X |
| 3,343,797 | 9/1967 | Bach | 239/333 X |
| 3,369,757 | 2/1968 | Boris | 239/333 X |
| 3,709,437 | 1/1973 | Wright | 222/190 X |
| 3,904,124 | 9/1975 | Caron et al. | 222/631 X |
| 4,057,176 | 11/1977 | Horvath | 239/333 X |
| 4,214,677 | 7/1980 | Bauer et al. | 239/333 X |
| 4,230,242 | 10/1980 | Meshberg | 222/321 |
| 4,880,161 | 11/1989 | Wright | 222/209 X |
| 5,064,103 | 11/1991 | Bennett | 222/190 |

FOREIGN PATENT DOCUMENTS

| | | | |
|---|---|---|---|
| 896330 | 10/1953 | Fed. Rep. of Germany | 222/394 |

*Primary Examiner*—Andres Kashnikow
*Assistant Examiner*—Anthoula Pomrening
*Attorney, Agent, or Firm*—Kenyon & Kenyon

[57] ABSTRACT

An actuator for a dispensing pump is disclosed that pressurizes air and releases the air into an internal fluid passage to mix with, and aerate, fluid dispensed from the dispensing pump and expels residual fluid. The actuator has a body portion, an actuating portion biased away from the body portion, and an air chamber formed between the two portions. Force applied to the actuating portion is transmitted to, and serves to operate, the dispensing pump and compresses the actuating portion toward the body portion, pressurizing the air in the air chamber. The pressurized air is selectively released into the fluid passage. Disclosed embodiments employ a dome-shaped resilient membrane and a piston as the actuating portion.

16 Claims, 5 Drawing Sheets

SELF-PURGING ACTUATOR

This application is a continuation-in-part of U.S. patent application Ser. No. 07/526,594, which was filed on May 22, 1990 and issued as U.S. Pat. No. 5,100,029 on Mar. 31, 1992.

BACKGROUND OF THE INVENTION

This invention relates to fluid dispensers in general, and more particularly to an actuator for actuating a dispensing pump that pressurizes air during a pumping cycle and introduces the pressurized air into the fluid passage of the actuator during the cycle to improve fluid atomization and/or after the cycle to clean out the passage.

Fluid dispensers are frequently fitted with dispensing pumps for dispensing a fluid product from the container of the dispenser. One type of dispensing pump for which the present invention is particularly well adapted is a modular pump, which is a self-contained structure that may be assembled and shipped separately from the rest of the dispenser.

A dispensing pump is typically fitted with an actuator, which is mounted on the stem of the dispensing pump. The actuator transmits force applied by the user to the pump stem to depress the stem and thereby dispense the fluid. The actuator contains a fluid passage to conduct the dispensed fluid from the pump stem to a discharge orifice that atomizes and discharges the fluid.

Two problems exist with current actuator and dispensing pump designs: the fluid passage can become clogged with fluid residue and the fluid can be inadequately atomized. Some fluid products dispensed by dispensing pumps, such as anti-perspirants and hair spray, are particularly susceptible to forming residues in actuator fluid passages if allowed to dry in the passage. Thus, an actuator on a hair spray or anti-perspirant dispenser that is not used every day can become clogged by residue, preventing the fluid dispenser from dispensing the fluid product. The user must then remove the actuator from the pump stem and immerse it in warm water to attempt to dissolve the clogging residue. As this step is often ineffective, the entire dispenser can be rendered useless.

The second problem with current actuator and dispensing pump designs is that the fluid, particularly consumer products such as anti-perspirants, may be inadequately atomized. The finer the mist that is produced by the fluid dispenser, the dryer the sensation when the mist contacts the user's skin. Dispensing pumps can be less effective than other dispensers, such as aerosols, in atomizing the fluid.

One approach to these problems is disclosed in U.S. Pat. No. 4,057,176 to Horvath. Horvath discloses a pump in which depression of the actuator pressurizes liquid to be dispensed in a central pump cylinder and pressurizes air in a concentric annular chamber formed between the actuator and the integral pump and screw cap assembly. The usual break-up insert is not provided so the pressurized liquid and air must be forced through pressure responsive seals into a mixing chamber, where the pressurized air atomizes the fluid.

The pump of Horvath suffers from several disadvantages. The mechanism is complex, involving many intricately-formed parts. More significantly, by forming the air chamber between the actuator and the integral pump and cap assembly, the disclosed mechanism for aerating the fluid cannot be used with other dispensing pumps or mounting caps.

Thus, it is evident that there is a need for a self-contained actuator that prevents clogging of the actuator fluid passage, improves atomization of the dispensed fluid, and can be used with any type of dispensing pump.

SUMMARY OF THE INVENTION

In accordance with the present invention, this need is fulfilled by incorporating into the actuator a self-contained mechanism for pressurizing ambient air and introducing the pressurized air into the actuator fluid passage. Pressurized air introduced into the fluid passage after fluid has been dispensed by a stroke of the pump expels residual fluid through the discharge orifice before the residue can dry and clog the passage. If the pressurized air is introduced during the dispensing stroke of the pump as well, the air mixes with and aerates the fluid, enhancing atomization of the fluid.

In the embodiments disclosed herein, the actuator is constructed with a body portion and an actuating portion biased away from the body portion. The body portion contains the fluid passage connecting the discharge orifice at one end with an opening at the other end into which the pump stem is inserted. An air chamber is formed between the body portion and actuating portion and communicates with the fluid passage via a second orifice. The actuating portion is biased outwardly from the body portion and is disposed opposite the opening in the body portion so that force applied to the outer, actuating surface of the actuating portion is transmitted axially t the stem to actuate the dispensing pump. Force applied to the actuating portion overcomes the outward biasing force and reduces the volume of the air chamber, pressurizing the air. The pressurized air is then introduced into the fluid passage via the second orifice.

In some of the embodiments, the second orifice is in continuous fluid communication with the fluid passage. By making the second orifice sufficiently small in one of these embodiments, passage of fluid into the air chamber can be prevented. In other of the embodiments, the second orifice is selectively closed by a valve to vary the time at which the pressurized air is introduced into the fluid passage. The air can be introduced first after the completion of a dispensing stroke of the pump or during the stroke.

The actuating portion can be a resilient membrane (either a shell-like dome or an articulated bellows) or a rigid piston. The membrane is biased outwardly by its own internal resilience, while the piston is biased outwardly by conventional biasing means such as a spring.

All of the embodiments disclosed herein are self-contained and can therefore be mounted on, and used with, any type of dispensing pump.

DETAILED DESCRIPTION

Figure 1:
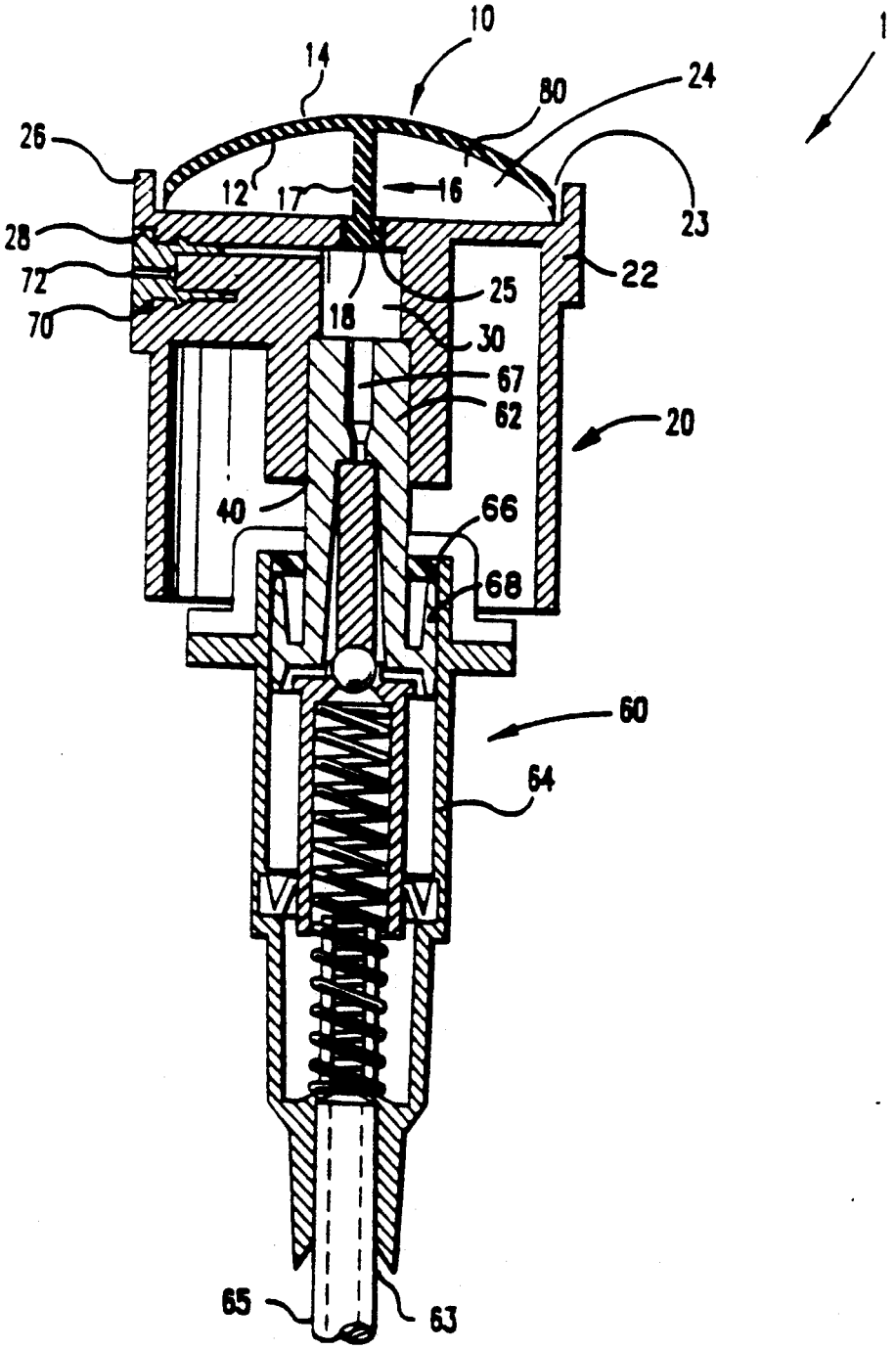
FIG. 1 is a cross sectional view of an actuator in accordance with a first embodiment of the invention attached to a modular, pre-pressurized dispensing pump.

FIG. 1 illustrates a first embodiment of the actuator. The actuator i includes an actuating portion 10 and a generally cylindrical body portion 20. The body portion is formed with a generally flat portion 22 having a recess 24 bounded by a circumferential lip 26.

The body portion 20 is also formed with an integral fluid passage 30 fluidly communicating at its inlet end with an opening 40. The opening is sized to accept in a sealing, force fit the stem 62 of dispensing pump 60. The fluid passage 30 connects at its outlet end with discharge orifice 72 formed in a mechanical breakup 70 snap fit into a receiving portion 28 formed in the body portion. A second orifice 25 is formed in the flat portion 22 of the body portion 20. The second orifice is in fluid communication with fluid passage 30.

The actuating portion 10 is a one-piece resilient membrane. It is formed in a dome shape from a resilient material and has an inner, pressurizing surface 12 and an outer, actuating surface 14. The resilient membrane is secured along its periphery to the radially inner side of the circumferential lip. An air chamber 80 is formed between the pressurizing surface and the surface of recess 24. The resilient membrane does not sealingly contact the circumferential lip over its full periphery, leaving a gap 23, which serves as a vent path and is closed during compression as explained below, between the resilient membrane and the circumferential lip that allows fluid communication between the air chamber and the atmosphere.

A downwardly depending valve stem 16 is integrally formed on the pressurizing surface 12. The valve stem has a smaller diameter, proximal portion 17 and a larger diameter, distal portion 18.

When the resilient membrane is in a relaxed, uncompressed state, the distal portion of the valve stem is disposed within the second orifice, forming a sealing fit and fluidically isolating the air chamber 80 from the fluid passage 30.

The internal configuration of the modular pump 60 may provide for a pre-pressurized type of operation, such as that disclosed in my prior U.S. Pat. No. 4,230,242, the disclosure of which is incorporated by reference herein. Thus, reference is made to this patent for a detailed discussion of the internal parts and operation of the pump 60. Any other type of dispensing pump known in the art may also be employed with the actuator of the invention.

As shown in FIG. 1, the modular, pre-pressurized pump 60 includes a pump housing 64, which has a large opening 66 at one axial end for receiving piston 68 and other internal parts of the pump, and a small opening 63 at the other axial end into which is inserted a dip tube 65 for supplying the fluid to be dispensed from the fluid dispenser (not shown) into the pump. Fluid dispensed by the pump is discharged via the discharge passage 67 formed within the stem 62.

In operation, the user applies a downward force to the actuating surface 14. The force is transmitted through the resilient membrane to the body portion of the actuator and thence to the stem 62 of the dispensing pump 60. The force counteracts the internal resilience of the resilient membrane and begins to compress it. When the membrane is slightly compressed, the periphery of the membrane expands radially outward to close the gap 23 and fluidically isolate the air chamber from the atmosphere. Further compression produced by applying increased force to the actuating surface begins to pressurize the air in the fluidically isolated air chamber. When the membrane is compressed further, the distal portion of the valve stem is displaced inwardly and out of sealing contact with the second orifice, allowing air to flow from the air chamber between the proximal portion of the valve stem and the perimeter of the second orifice, and into the fluid passage.

As the force applied to the actuating surface compresses the resilient member, it also displaces the stem 62 of the dispensing pump. The pump discharges fluid through the discharge passage 67 over some portion of pump's stroke and ceases discharging fluid when the end of the stroke is reached. By appropriate selection of the length of the distal portion of the valve stem and the degree of resilience of the membrane in relation to the spring constant of the dispensing pump, the release of air from the air chamber into the fluid passage can be initiated at any point in the pump's stroke.

If the pressurized air is not released until after the pump has ceased discharging fluid, the pressurized air expels residual fluid in the fluid passage through the discharge orifice as the air flows through the fluid passage. If release of the pressurized air begins while the fluid is being discharged from the pump, the air will mix with the fluid, thus aerating it and improving atomization of the fluid as it is discharged from the discharge orifice of the actuator.

After the pump stem has been depressed through its full stroke and the resilient membrane has been fully compressed, the user releases the actuator. The outward bias in the dispensing pump returns the pump stem to its resting, unoperated position and the internal resilience of the resilient membrane restores the membrane to its uncompressed position. Air is drawn into the air chamber via the gap 23 to refill the chamber.

Figure 2A:
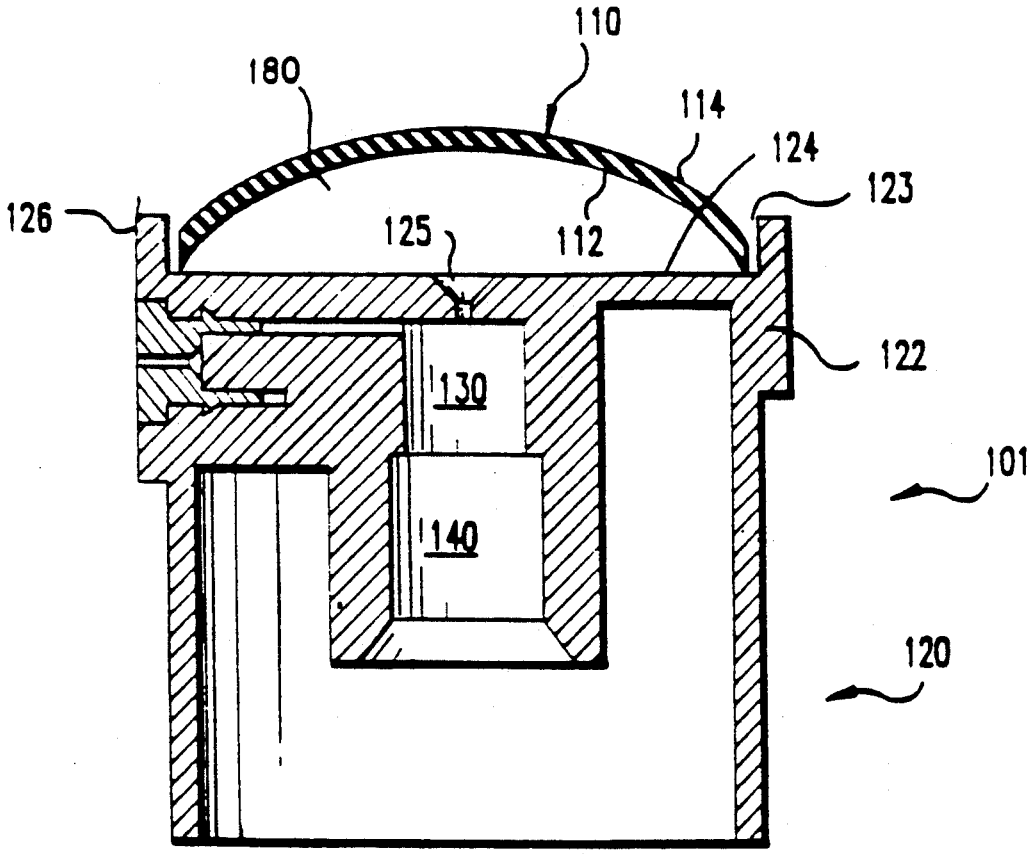
FIG. 2A is a cross sectional view of an actuator in accordance with a second embodiment of the invention.

FIG. 2A illustrates an actuator in accordance with a second embodiment of the invention. In this embodiment, the second orifice 125 in flat portion 124 of body portion 120 is formed with a smaller diameter. By making this second orifice sufficiently small, for example in the range of 0.002" to 0.010" in diameter, the orifice will prevent fluid in the fluid passage from entering the air chamber while allowing pressurized air in the air chamber to enter the fluid passage. The required orifice diameter will depend on several factors, including the viscosity of the fluid, the relative operating pressure of the air and the fluid, and the volume of the air chamber.

In this embodiment, the pressurized air is introduced into the fluid passage upon application of pressure to the actuating surface 114 of the resilient membrane 110 as there is no valve member to seal the second orifice.

Since the pressurized air is introduced into the fluid passage throughout the stroke of the dispensing pump, this embodiment will enhance atomization by aerating the dispensed fluid. The air chamber volume can be designed to be sufficiently large to have a volume of air remaining at the end of the dispensing pump stroke to purge the fluid passage.

Figure 2B:
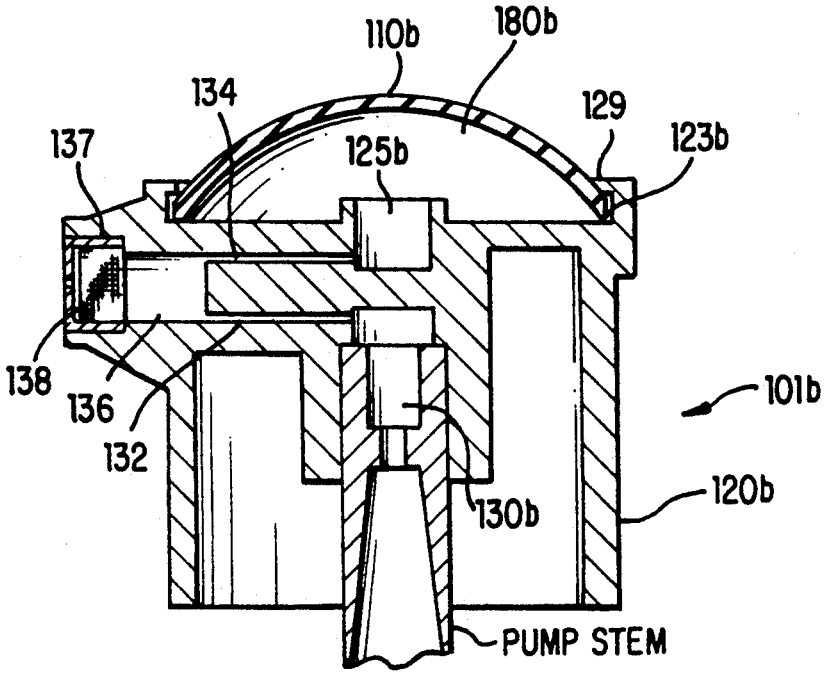
FIG. 2B is a cross sectional view of an actuator in accordance with a third embodiment of the invention.

FIG. 2B illustrates a variant of the embodiment shown in FIG. 2A, in which the mixing of air and fluid occurs in a mixing chamber adjacent the atomizer. In this variant, the second orifice **125*b* leads to an air channel 134, which terminates in mixing chamber 136. Liquid is forced through fluid passage 130*b*, which is connected to the mixing chamber by a liquid channel 132**.

Pressurized air and liquid are mixed in the mixing chamber, and the resulting aerated mixture is expelled through a two piece atomizing assembly. This atomizing assembly consists of element 138, which can take the form of a fine screen or a plurality of screens for creating a foam when a soapy formula is dispensed, and a surrounding annular element 137, which contains a nozzle through which the air-liquid mixture is dispensed. Also shown in this embodiment is overhang 129, which assists in the retention of the resilient membrane 110 (this retaining overhang may also be provided in the embodiment shown in FIG. 2A).

Figure 2C:
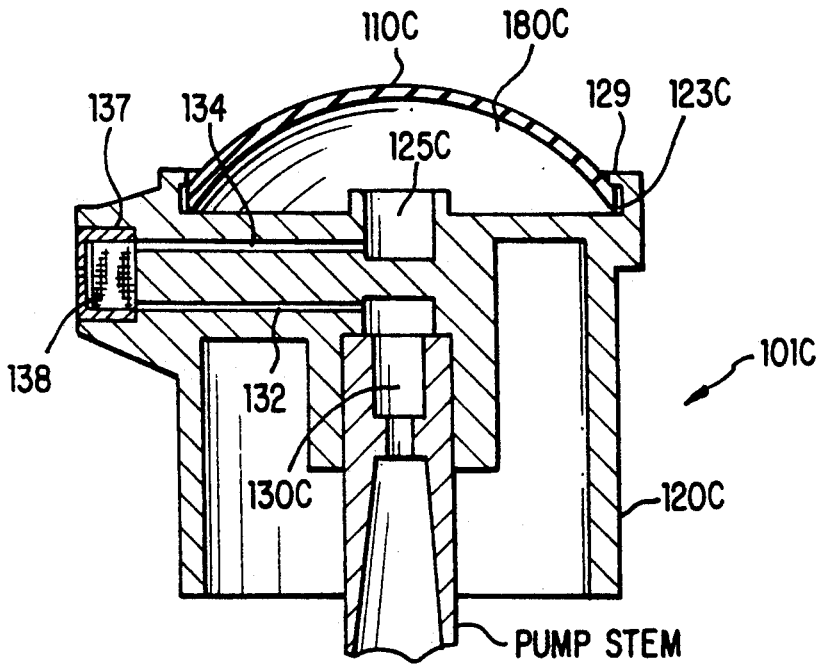
FIG. 2C is a cross sectional view of an actuator in accordance with a fourth embodiment of the invention.

A further variation of this design is shown in FIG. 2C, in which the mixing chamber has been eliminated. In this embodiment, the liquid and air channels extend to a conventional mechanical break-up, where they are combined to form an aerated fluid flow. The break-up (which again is kept clear by the air flow) may be provided as a two-piece atomizing assembly such as that which has been described with respect to FIG. 2B.

In any of the above embodiments, the resilient membrane can be in the form of a bellows rather than a dome.

Figure 3:
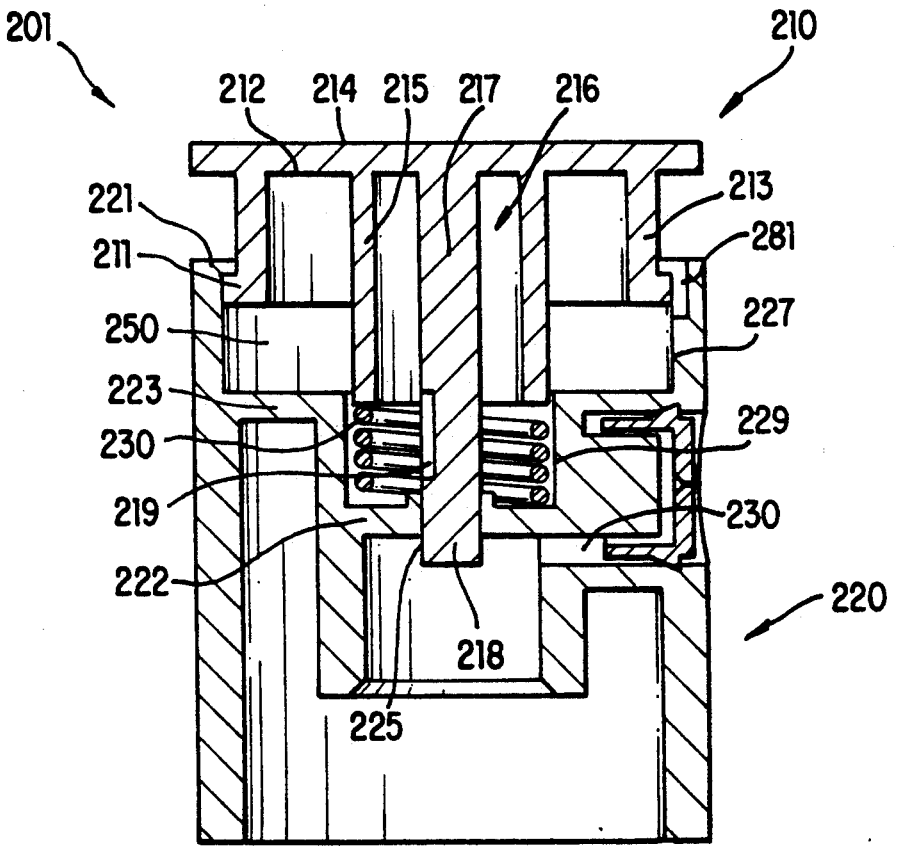
FIG. 3 is a cross sectional view of an actuator in accordance with a fifth embodiment of the invention.

FIG. 3 illustrates an actuator in accordance with a another embodiment of the invention. In this embodiment, the body portion 220 of actuator 201 is formed with an outer, larger diameter bore 227 and a concentric, inner, smaller diameter bore 229. The inner end of the larger diameter bore terminates in a generally flat portion 223 and the smaller diameter bore terminates in a bottom end 222. Second orifice 225 is formed in bottom end 222.

The outer end of the larger diameter bore is closed by a piston 210. The piston has a pressurizing surface 212 and an actuating surface 214. A radially outer annular portion 213 and a radially inner annular portion 215 depend downwardly from the pressurizing surface. Annular portion 215 is guidably received in smaller diameter bore 229. Air chamber 280 is formed between the pressurizing surface of the piston, the surface of the bores 227 and 229, the outer surface of flat portion 223, and bottom end 222.

Valve stem 216 depends downwardly from the pressurizing surface of piston 210. The valve stem is formed with a distal portion 218 which sealingly engages second orifice 225. Proximal portion 217 is formed with an axial groove 219 having an axial length greater than that of second orifice 225. When the valve stem is axially located within second orifice 225 so that groove 219 straddles second orifice 225, air within air chamber 280 can flow through the groove and into the fluid passage 230.

Piston 210 is biased outwardly by spring 290. The spring is disposed within the smaller diameter bore 229, with its inner end seated against bottom end 222. The spring's outer end is seated against the axially inner end of inner annular portion 215 of piston 210. The piston is restrained from outward displacement at the outer end of the larger diameter bore by the interlock of upper lip 221 formed at the outer end of larger diameter bore 227 and lower lip 211 formed at the inner end of outer annular portion 213.

An axial notch 281 is formed in upper lip 221 and large diameter bore 227. The notch provides fluid communication between the air chamber and the ambient air when the piston is near its unactuated, axially outer position and is blocked by lower lip 211 when the piston is displaced inwardly.

In operation, the user applies a downward force to the actuating surface 214. The force is transmitted through the piston 210 and the spring 290 to the body portion 220 of the actuator and thence to the stem of the dispensing pump. The force counteracts the outward bias of the spring and begins to compress it. When the spring is slightly compressed, axial notch 281 is covered by bore 227 thereby fluidically isolating the air chamber 280 from the atmosphere. Further compression produced by applying increased force to the actuating surface begins to pressurize the air in the fluidically isolated air chamber. When the piston is compressed further, the distal portion of the valve stem is displaced inwardly and out of sealing contact with the second orifice, allowing air to flow from the air chamber through the axial groove 219 and the second orifice, and into the fluid passage.

As the force applied to the actuating surface compresses the piston, it also displaces the pump stem. The pump discharges fluid over some portion of pump's stroke and ceases discharging fluid when the end of the stroke is reached. By appropriate selection of the axial location and length of the groove 219 and the spring constant of the spring in relation to the spring constant of the dispensing pump, the release of air from the air chamber into the fluid passage can be initiated at any point in the pump's stroke.

As described above, the pressurized air can be used to aerate the dispensed fluid as well as to expel residual fluid.

After the pump stem has been depressed through its full stroke and the spring has been fully compressed, the user releases the actuator. The outward bias in the dispensing pump returns the pump stem to its resting, unoperated position and the outward bias of the spring restores the piston to its uncompressed position. Air is drawn into the air chamber via the axial notch 281 to refill the chamber.

What is claimed is:

1. An actuator for operating a dispensing pump comprising:

a. a body portion having an upper end, a lower end, an exterior surface, and a fluid passage contained therein;

b. a first orifice provided in said exterior surface of said body portion communicating with said fluid passage;

c. an opening for receiving a stem of a separate dispensing pump, said opening being a fluidic communication with said fluid passage;

d. a manually manipulable actuating portion comprising a resilient membrane that is spaced outwardly from said upper end of said body portion and operatively attached to said upper end of said body portion and supported therein for reciprocating motion relative to said body portion through a range of motion and defining therewith an air chamber; and e. a second passage disposed between said air chamber and said fluid passage whereby movement of said actuating portion relative to said body portion pressurizes the air within said air chamber such that it flows from the air chamber via the second passage into the fluid passage and thence through the orifice.

2. The actuator of claim 1 wherein said second passage comprises a second orifice.

3. The actuator of claim 1 wherein said fluid passage includes a mixing chamber adjacent said orifice and said second passage has a first end and a second end, said first end being in fluidic communication with said air chamber and said second end being in fluidic communication with said mixing chamber.

4. The actuator of claim 3 wherein said opening is formed in said lower end of said body portion.

5. The actuator of claim 3 further comprising a plurality of screens disposed within said mixing chamber adjacent said first orifice.

6. The actuator of claim 1 wherein said actuating portion has a perimeter, at least a portion of which is supported by said upper end of said body portion.

7. The actuator of claim 6 wherein said actuating portion has an outer actuating surface and an inner pressurizing surface, said air chamber being formed between said inner pressurizing surface and said upper end of said body portion.

8. The actuator of claim 1 wherein said second passage has a first end and a second end, said first end being in fluidic communication with said air chamber and said second end being in fluidic communication with said first orifice.

9. An actuator for operating a dispensing pump comprising:

a. a body portion having an upper end, a lower end, an exterior surface, and a fluid passage contained therein;

b. a first orifice provided in said exterior surface of said body portion communicating with said fluid passage;

c. an opening for receiving a stem of a separate dispensing pump, said opening being a fluidic communication with said fluid passage;

d. a manually manipulable actuating portion comprising a resilient membrane that is spaced outwardly from said upper end of said body portion and operatively attached to said upper end of said body portion and supported therein for reciprocating motion relative to said body portion through a range of motion and defining therewith an air chamber; and c. a second passage disposed between said air chamber and said fluid passage whereby movement of said actuating portion relative to said body portion pressurizes the air within said air chamber such that it flows from the air chamber via the second passage and through the first orifice.

10. The actuator of claim 9 wherein said second passage comprises a second orifice.

11. The actuator of claim 9 wherein said fluid passage includes a mixing chamber adjacent said first orifice and said second passage has a first end and a second end, said first end being in fluidic communication with said air chamber and said second end being in fluidic communication with said mixing chamber.

12. The actuator of claim 11 wherein said opening is formed in said lower end of said body portion.

13. The actuator of claim 9 wherein said actuating portion has a perimeter, at least a portion of which is supported by said upper end of said body portion.

14. The actuator of claim 13 wherein said actuating portion has an outer actuating surface and an inner pressurizing surface, said air chamber being formed between said inner pressurizing surface and said upper end of said body portion.

15. The actuator of claim 9 further comprising a plurality of screens disposed adjacent said first orifice.

16. The actuator of claim 9 wherein said second passage has a first end and a second end, said first end being in fluidic communication with said air chamber and said second end being in fluidic communication with said first orifice.

* * * * *